US010532565B2

(12) United States Patent
Osuki et al.

(10) Patent No.: US 10,532,565 B2
(45) Date of Patent: Jan. 14, 2020

(54) PRINT ELEMENT SUBSTRATE, PRINTHEAD, AND PRINTING APPARATUS

(71) Applicant: CANON KABUSHIKI KAISHA, Tokyo (JP)

(72) Inventors: Yohei Osuki, Nagareyama (JP); Masataka Sakurai, Kawasaki (JP); Ryo Kasai, Tokyo (JP); Kengo Umeda, Tokyo (JP); Hidenori Yamato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/011,109

(22) Filed: Jun. 18, 2018

(65) Prior Publication Data

US 2018/0370224 A1 Dec. 27, 2018

(30) Foreign Application Priority Data

Jun. 27, 2017 (JP) ..... 2017-125587
Jun. 1, 2018 (JP) ..... 2018-106311

(51) Int. Cl.
*B41J 2/045* (2006.01)

(52) U.S. Cl.
CPC ..... *B41J 2/04541* (2013.01); *B41J 2/0457* (2013.01)

(58) Field of Classification Search
CPC ..... B41J 2/04541; B41J 2/0457
See application file for complete search history.

(56) References Cited

U.S. PATENT DOCUMENTS 7,559,626 B2 7/2009 Sakurai et al.
7,559,628 B2 7/2009 Sakurai
8,342,620 B2 1/2013 Kasai et al.
8,740,350 B2 6/2014 Sakurai et al.
2009/0278879 A1* 11/2009 Takeuchi ..... B41J 2/04543 347/12

FOREIGN PATENT DOCUMENTS

JP 5473767 B2 11/2011

OTHER PUBLICATIONS

IP.com search (Year: 2019).*

* cited by examiner

*Primary Examiner* — Lisa Solomon
(74) *Attorney, Agent, or Firm* — Venable LLP

(57) ABSTRACT

In a print element substrate: if an amount of a voltage drop when the number of print elements driven simultaneously in a state in which the predetermined voltage is applied with respect to one print element array is largest is set as an amount of a voltage drop of the print element array, and a sum of amounts of voltage drops of the print element arrays assigned to one group is set as an amount of a voltage drop of the group, a difference between a largest value and a smallest value of the amounts of the voltage drops of the M groups is smaller than a largest value of the amounts of the voltage drops of the N print element arrays.

9 Claims, 14 Drawing Sheets

PRINT ELEMENT SUBSTRATE, PRINTHEAD, AND PRINTING APPARATUS

BACKGROUND OF THE INVENTION

Field of the Invention

The present invention relates to a print element substrate, a printhead, and a printing apparatus.

Description of the Related Art

There are known inkjet printheads (to be referred to as printheads hereinafter) that form ink droplets discharged by various methods. Among them, a printhead that uses heat as energy for ink discharge can relatively readily implement high-density multi-nozzles, and can execute high-resolution, high-quality, and high-speed printing.

In recent years, the number of elements tends to increase to improve the resolution and image quality, and an increase in number of terminals of the printhead to drive the elements poses a problem. Since an increase in number of terminals of the printhead influences the head cost and reliability of electrical connection, the number of terminals is desirably reduced as much as possible.

In Japanese Patent No. 5473767, a terminal of an HE (Heat Enable) signal that defines a time for driving an element and is conventionally transmitted from the outside of a printhead is reduced by generating the HE signal in a substrate.

In Japanese Patent No. 5473767, an HE signal generation circuit that generates an HE signal is provided for each print element array. As a result, the number of HE signal generation circuits increases along with an increase in number of print element arrays, and each HE signal generation circuit is large in terms of a circuit scale, suppressing a circuit space. As a measure against this, there is provided a method of sharing an HE signal among a plurality of print element arrays and performing driving for each HE signal. This can suppress an increase in number of HE signal generation circuits. If, however, an amount of a voltage drop is different for each print element array, a new problem that an amount of a voltage drop changes when driving each HE signal arises. It is necessary to set a relatively long pulse width for an HE signal in accordance with a print element for which the amount of a voltage drop is largest, resulting in shortening of the life of the print element.

SUMMARY OF THE INVENTION

The present invention suppresses shortening of the life of a print element while reducing the cost by sharing an HE signal to reduce a circuit space.

According to one aspect of the present invention, there is provided a print element substrate comprising: N (N≥3) circuit element arrays each including a print element array with a plurality of print elements and a plurality of driving elements configured to drive the plurality of print elements of the print element array, each assigned to one of M (2≤M<N) groups, and connected in parallel, via connected wirings, to an input unit to which a predetermined voltage is input; and M signal generation circuits provided in correspondence with the M groups, and configured to generate M driving signals which determine a period during which the print element is driven and output the M driving signals to the circuit element arrays belonging to the corresponding groups, respectively, for each group, so as to drive the driving elements of one circuit element array belonging to the corresponding groups or to drive simultaneously the circuit element arrays belonging to the corresponding groups, wherein if an amount of a voltage drop when the number of print elements driven simultaneously in a state in which the predetermined voltage is applied with respect to one print element array is largest is set as an amount of a voltage drop of the print element array, and a sum of amounts of voltage drops of the print element arrays assigned to one group is set as an amount of a voltage drop of the group, a difference between a largest value and a smallest value of the amounts of the voltage drops of the M groups is smaller than a largest value of the amounts of the voltage drops of the N print element arrays.

According to another aspect of the present invention, there is provided a printhead comprising a plurality of print element substrates, each of the plurality of print element substrates including N (N≥3) circuit element arrays each including a print element array with a plurality of print elements and a plurality of driving elements configured to drive the plurality of print elements of the print element array, each assigned to one of M (2≤M<N) groups, and connected in parallel, via connected wirings, to an input unit to which a predetermined voltage is input, and M signal generation circuits provided in correspondence with the M groups, and configured to generate M driving signals which determine a period during which the print element is driven and output the M driving signals to the circuit element arrays belonging to the corresponding groups, respectively, for each group, so as to drive the driving elements of one circuit element array belonging to the corresponding groups or to drive simultaneously the circuit element arrays belonging to the corresponding groups, wherein if an amount of a voltage drop when the number of print elements driven simultaneously in a state in which the predetermined voltage is applied with respect to one print element array is largest is set as an amount of a voltage drop of the print element array, and a sum of amounts of voltage drops of the print element arrays assigned to one group is set as an amount of a voltage drop of the group, a difference between a largest value and a smallest value of the amounts of the voltage drops of the M groups is smaller than a largest value of the amounts of the voltage drops of the N print element arrays.

According to another aspect of the present invention, there is provided a printing apparatus comprising a printhead with a plurality of print element substrates, each of the plurality of print element substrates including N (N≥3) circuit element arrays each including a print element array with a plurality of print elements and a plurality of driving elements configured to drive the plurality of print elements of the print element array, each assigned to one of M (2≤M<N) groups, and connected in parallel, via connected wirings, to an input unit to which a predetermined voltage is input, and M signal generation circuits provided in correspondence with the M groups, and configured to generate M driving signals which determine a period during the print element is driven and output the M driving signals to the circuit element arrays belonging to the corresponding groups, respectively, for each group, so as to drive the driving elements of one circuit element array belonging to the corresponding groups or to drive simultaneously the circuit element arrays belonging to the corresponding groups, wherein if an amount of a voltage drop when the number of print elements driven simultaneously in a state in which the predetermined voltage is applied with respect to one print element array is largest is set as an amount of a voltage drop of the print element array, and a sum of amounts of voltage drops of the print element arrays assigned to one group is set as an amount of a voltage drop of the group, a difference between a largest value and a smallest value of the amounts of the voltage drops of the M groups is smaller than a largest value of the amounts of the voltage drops of the N print element arrays.

According to another aspect of the present invention, there is provided a print element substrate comprising: N (≥3) print element arrays each including a plurality of print elements wherein the print element arrays are connected in parallel, via connected wirings, to an input unit to which a predetermined voltage is input; a signal generation unit configured to generate M (≥2, <N) driving signals for driving the N print element arrays wherein each of the driving signals determines a period during which the print element is driven; and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

According to another aspect of the present invention, there is provided a printhead comprising a plurality of print element substrates, each of the plurality of print element substrates including N (≥3) print element arrays each including a plurality of print elements wherein the print element arrays are connected in parallel, via connected wirings, to an input unit to which a predetermined voltage is input, a signal generation unit configured to generate M (≥2, <N) driving signals for driving the N print element arrays wherein each of the driving signals determines a period during which the print element is driven, and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

According to another aspect of the present invention, there is provided a printing apparatus comprising a plurality of print element substrates, each of the plurality of print element substrates including N (≥3) print element arrays each including a plurality of print elements wherein the print element arrays are connected in parallel, via connected wirings, to an input unit to which a predetermined voltage is input, a signal generation unit configured to generate M (≥2, <N) driving signals for driving the N print element arrays wherein each of the driving signals determines a period during which the print element is driven, and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

According to the present invention, in a print element substrate, it is possible to suppress shortening of the life of a print element while reducing the cost by sharing an HE signal to reduce a circuit space.

Further features of the present invention will become apparent from the following description of exemplary embodiments (with reference to the attached drawings).

DESCRIPTION OF THE EMBODIMENTS

In this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be broadly interpreted similarly to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "print element" generically means an orifice or a liquid channel communicating with it, and an element for generating energy used to discharge ink, unless otherwise specified.

Further, a "nozzle" generically means an orifice or a liquid channel communicating with it, and an element for generating energy used to discharge ink, unless otherwise specified.

A printhead element substrate (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

The printhead according to the present invention will be explained in an example in which a printing apparatus including a full-line printhead whose printing width corresponds to the width of a print medium is used. Note that the present invention is not limited to this, and may be used for a printing apparatus including a serial type printhead if a problem to be solved by the present invention may arise due to the length of a wiring or the like.

[Overview of Printing Apparatus]

Figure 1:
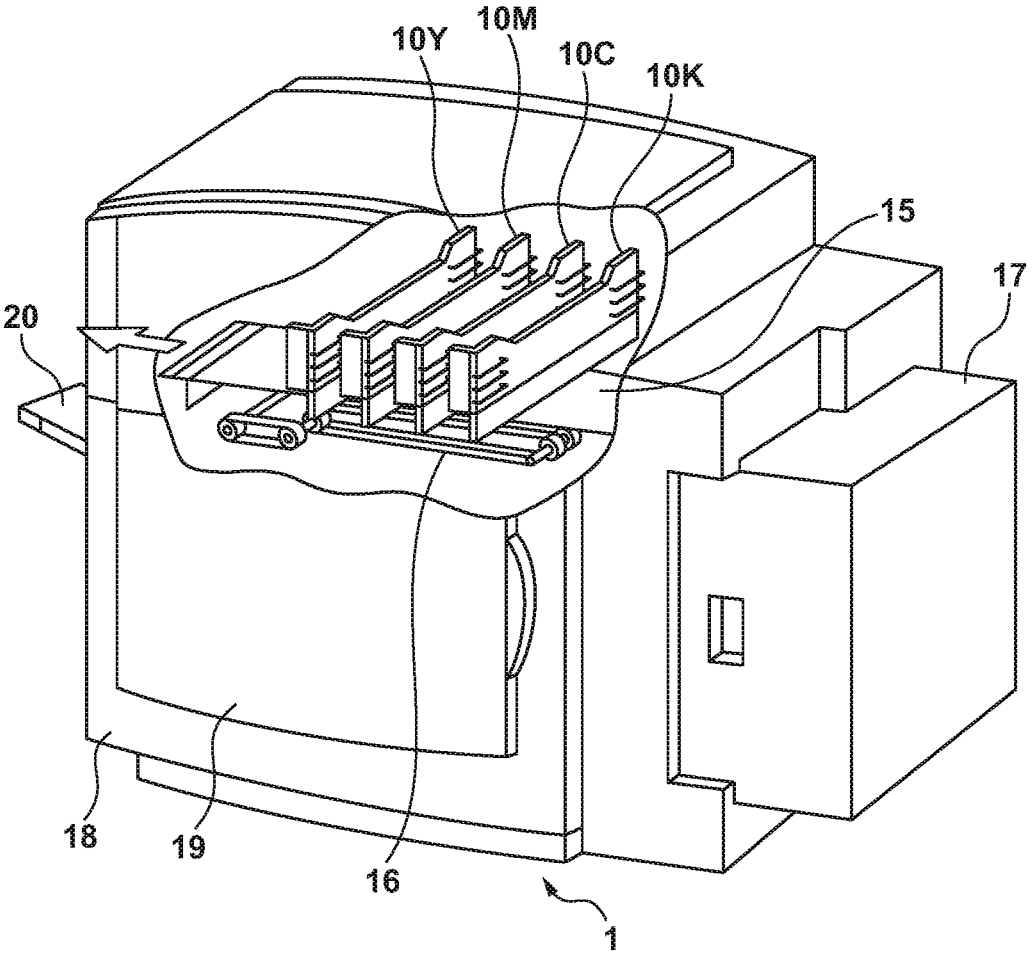
FIG. 1 is a perspective view showing an example of the outer appearance of an inkjet printing apparatus.
Figure 11:
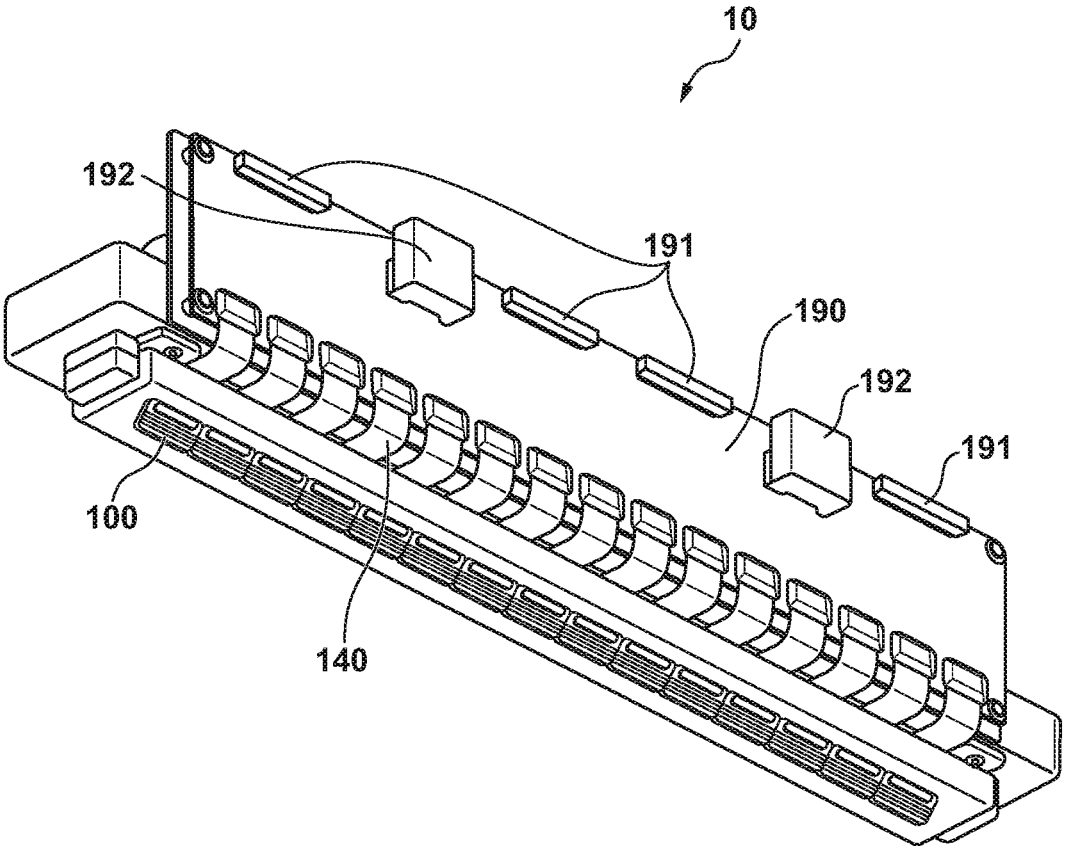
FIG. 11 is a perspective view showing a printhead according to the present invention.

FIG. 1 is a perspective view for explaining the structure of a printing apparatus 1 which includes full-line inkjet printheads (to be referred to as printheads hereinafter) 10K, 10C, 10M, and 10Y and a recovery unit for always guaranteeing stable ink discharge. Note that a description will be provided below by exemplifying the printheads corresponding to four inks. However, the present invention is not limited to this number. A common arrangement in the printheads will be explained using printheads 10 with suffixes omitted. FIG. 11 is a perspective view showing the printhead 10. The printhead 10 is a line printhead (liquid discharge head) in which 15 print element substrates 100 are arrayed on a line (arranged in line). As shown in FIG. 11, the printhead 10 is provided with the plurality of print element substrates 100, signal input terminals 191 electrically connected via flexible wiring substrates 140 and an electric wiring substrate 190, and power supply terminals 192. The signal input terminals 191 and the power supply terminals 192 are electrically connected to a control unit of the printing apparatus 1, and supply discharge driving signals and power needed for discharge to the print element substrates 100. It is possible to reduce the number of signal input terminals 191 and the number of power supply terminals 192 as compared with the number of print element substrates 100 by aggregating wirings with an electric circuit in the electric wiring substrate 190. This can reduce the number of electrical connection portions that need to be detached when the printhead 10 is replaced or attached to a printing apparatus 1.

In the printing apparatus 1, a print medium 15 is supplied from a feeder unit 17 to a print position by these printheads 10 and conveyed by a conveyance unit 16 included in a housing 18 of the printing apparatus 1.

In printing an image on the print medium 15, when the reference position of the print medium 15 reaches a position under the printhead 10K which discharges black (K) ink while conveying the print medium 15, the printhead 10K discharges the black ink. Similarly, when the print medium 15 reaches respective reference positions in the order of the printhead 10C that discharges cyan (C) ink, the printhead 10M that discharges magenta (M) ink, and the printhead 10Y that discharges yellow (Y) ink, the inks of the respective colors are discharged to form a color image. The print medium 15 on which the image is thus printed is discharged and stacked on a stacker tray 20.

The printing apparatus 1 further includes the conveyance unit 16, and ink cartridges (not shown) configured to supply the inks to the printheads 10 and replaceable for each ink. In addition, the printing apparatus 1 includes, for example, a pump unit (not shown) for a recovery operation and ink supply to the printhead 10, and a control board (not shown) that controls the overall printing apparatus 1. A front door 19 is an opening/closing door for replacing the ink cartridge.

[Control Arrangement]

Next, a control arrangement for executing printing control of the printing apparatus described with reference to FIG. 1 will be explained.

Figure 2:
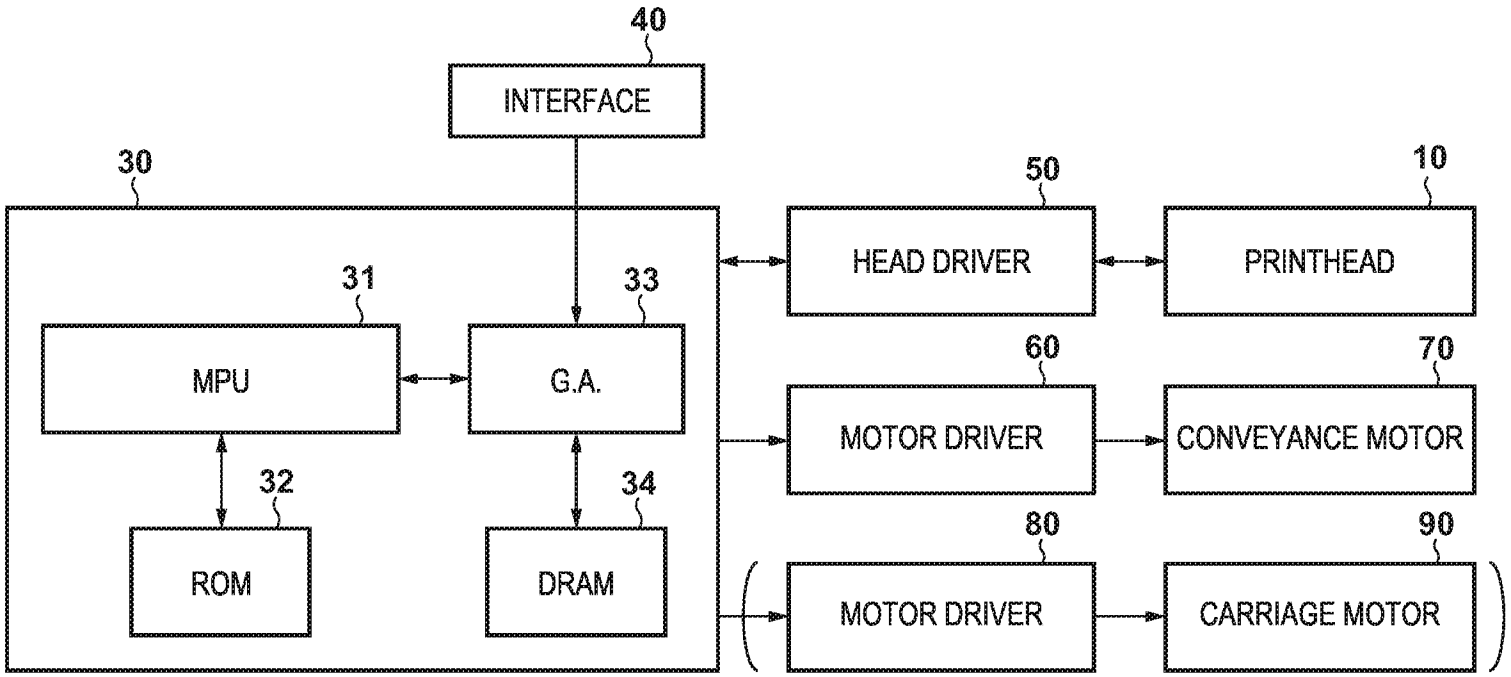
FIG. 2 is a block diagram showing an example of the control arrangement of the inkjet printing apparatus according to the present invention.

FIG. 2 is a block diagram showing the arrangement of the control circuit of the printing apparatus 1. In FIG. 2, a controller 30 includes an MPU 31, a ROM 32, a gate array (G.A.) 33, and a DRAM 34. An interface 40 is an interface for inputting print data. The ROM 32 is a non-volatile storage area and stores a control program executed by the MPU 31. The DRAM 34 is a DRAM for saving data such as print data and print signals to be supplied to the printheads 10. The gate array 33 is a gate array for controlling supply of print signals to the printheads 10, and also controlling data transfer among the interface 40, the MPU 31, and the DRAM 34. A carriage motor 90 is a motor for conveying the printheads 10. A conveyance motor 70 is a motor for conveying a printing sheet. A head driver 50 drives the printheads 10. Motor drivers 60 and 80 are motor drivers for driving the conveyance motor 70 and the carriage motor 90, respectively.

Note that in the printing apparatus having the arrangement using the full-line printheads shown in FIG. 1, the carriage motor 90 and the motor driver 80 for driving it are not arranged. Therefore, the motor driver 80 and the carriage motor 90 are parenthesized in FIG. 2.

The operation of the above control arrangement will be explained. When print data is input to the interface 40, it is converted into a print signal for printing between the gate array 33 and the MPU 31. Then, simultaneously with driving of the motor drivers 60 and 80, the printheads 10 are driven in accordance with the print data sent to the head driver 50, thereby performing printing.

First Embodiment

The arrangement of a print element substrate according to the first embodiment of the present invention will be described with reference to the accompanying drawings.

Figure 3:
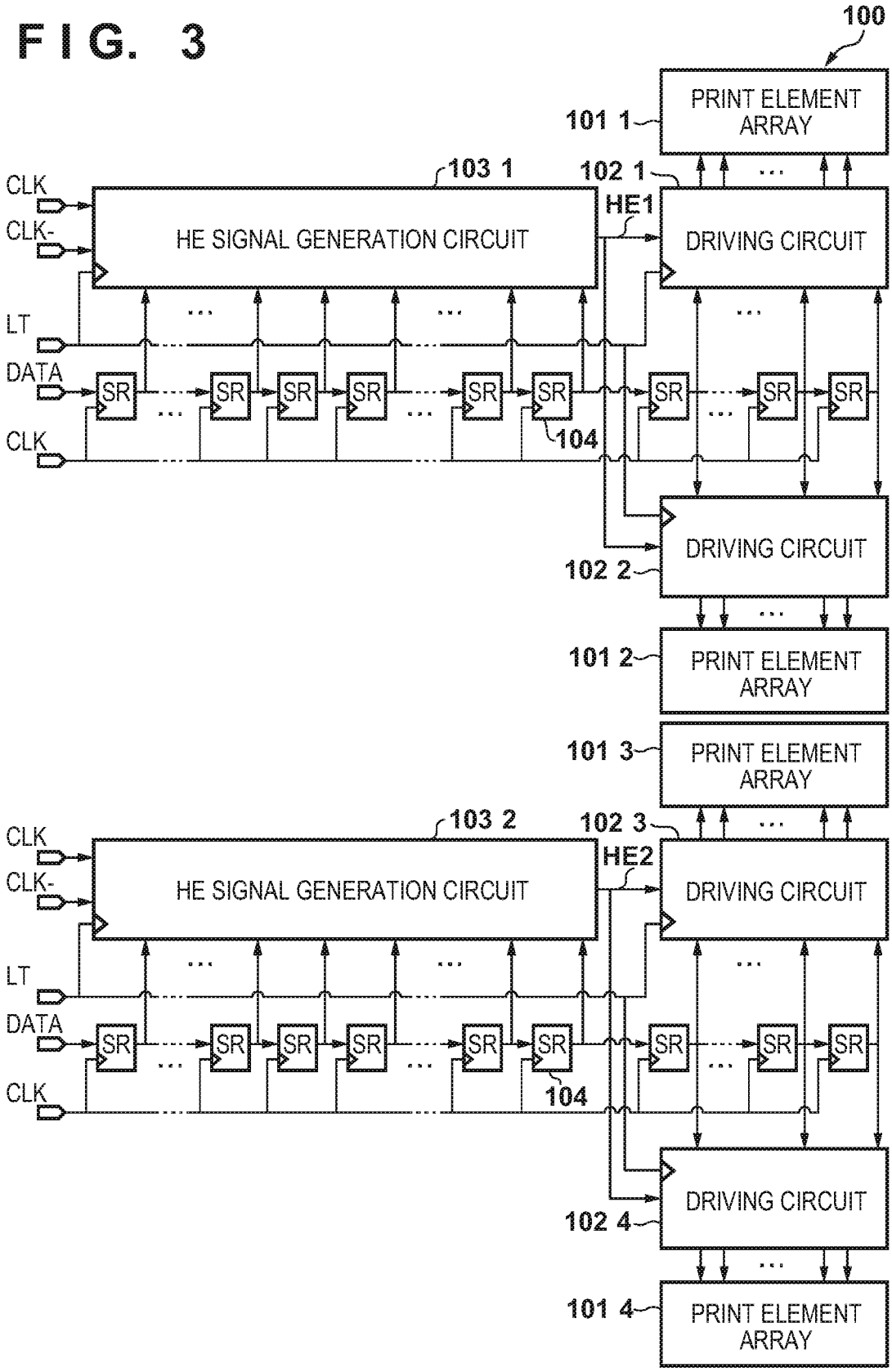
FIG. 3 is a block diagram showing an example of the overall arrangement of a print element substrate according to the present invention.

FIG. 3 is a block diagram showing the schematic arrangement of the overall circuit of each of a plurality of print element substrates 100 provided in a printhead 10 according to this embodiment. Each print element substrate 100 includes print element arrays 101 (four print element arrays 101-1, 101-2, 101-3, and 101-4), driving circuits 102 (four driving circuits 102-1, 102-2, 102-3, and 102-4), HE signal generation circuits 103 (two HE signal generation circuits 103-1 and 103-2), and shift registers (SRs) 104. Each print element array 101 is formed by arranging a plurality of print elements each for discharging ink. Each driving circuit 102 is a circuit for selecting and driving the print element in the corresponding print element array 101. Each HE signal generation circuit 103 generates a heat enable signal (HE signal) for determining a period during which each print element is driven (energized). The HE signal generation circuit 103-1 outputs a heat enable signal (HE1) to the driving circuits 102-1 and 102-2. Based on HE1, the print element arrays 101-1 and 101-2 are driven simultaneously. The HE signal generation circuit 103-2 outputs a heat enable signal (HE2) to the driving circuits 102-3 and 102-4. Based on HE2, the print element arrays 101-3 and 101-4 are driven simultaneously. Each SR 104 is a shift register that loads print element selection data, driving signal rising timing data, and driving signal falling timing data from a DATA signal (first signal). More specifically, for example, if the print element selection data set in the driving circuits 102-1 and 102-2 includes identification data, it is possible to set, based on the value of the identification data, whether to drive one or both of the print element arrays 101-1 and 101-2. The driving circuits 102-3 and 102-4 have the same circuit arrangement, and the print element to be driven may be set by a predetermined signal. Note that the number of provided SRs 104 changes in accordance with the resolution of the print element substrate 100 and the like.

Figure 12:
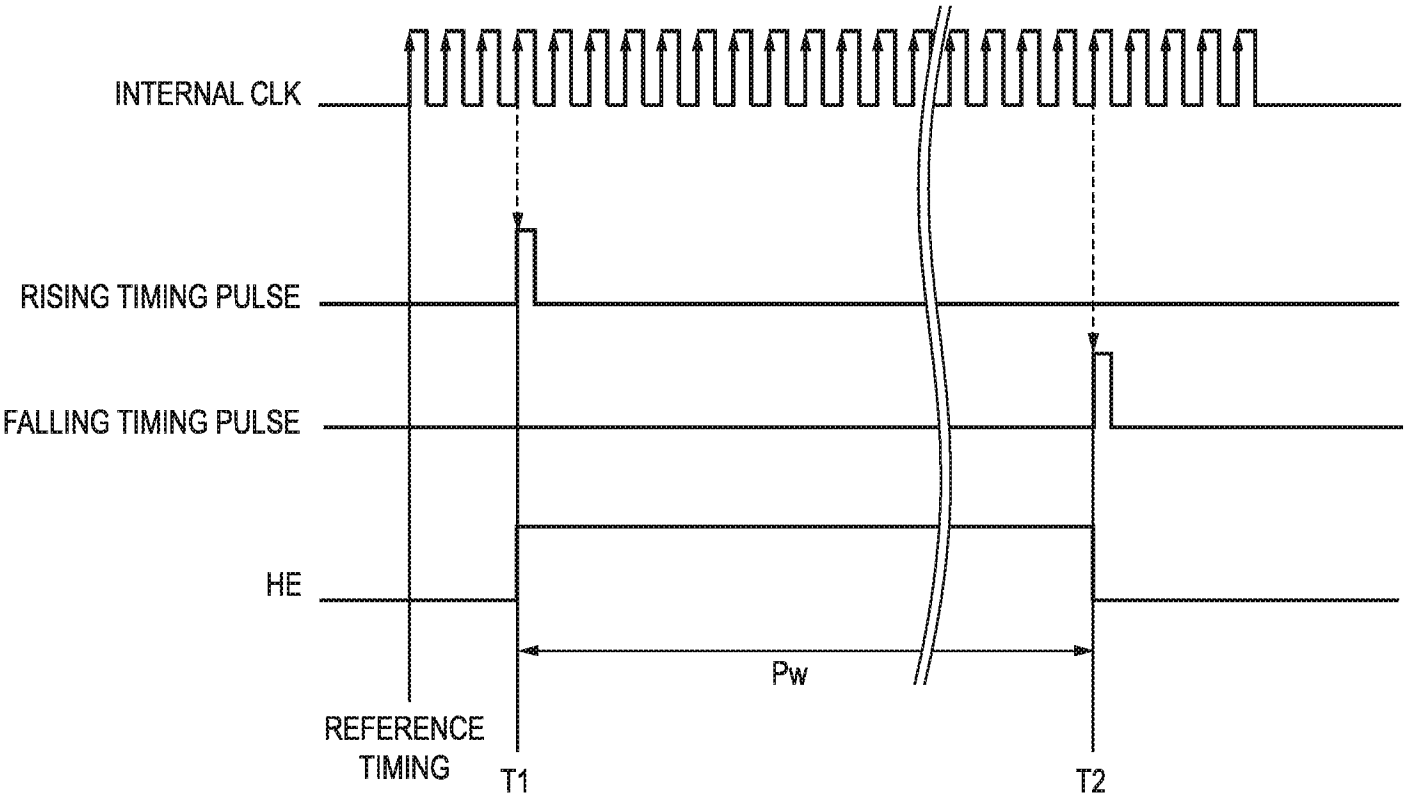
FIG. 12 is a timing chart showing an example of the operation of an HE signal generation circuit shown in FIG. 3.

DATA is a data signal related to driving, such as print element selection data, driving signal rising timing data, and driving signal falling timing data; CLK, a clock signal; and LT, a latch signal. CLK+ and CLK− are clock signals whose phases are inverted from each other. The DATA signal is loaded to the SR 104 of the print element substrate 100 in synchronism with the CLK signal, and data is confirmed in the HE signal generation circuit 103 and the driving circuit 102 by the LT signal. In this example, one HE signal generation circuit 103 generates an HE signal (second signal), and provides the generated HE signal to the two print element arrays 101 to drive them. As described above, in the circuit shown in FIG. 3, reception of the data signal and the latch signal and generation of the HE signal are performed in the driving cycle of the print element. FIG. 12 shows the internal operation of the HE signal generation circuit 103 in one driving cycle of the print element. The HE signal generation circuit 103 receives CLK+ and CLK− using LVDS (Low Voltage Differential Signaling), and generates an internal CLK signal based on them. The HE signal generation circuit 103 receives the driving signal rising timing data and the driving signal falling timing data from the SRs 104, and counts the number of rising edges of the internal CLK signal from a reference timing. This generates a rising timing pulse at a timing T1, and generates a falling timing pulse at a timing T2. The HE signal generation circuit 103 generates a driving signal (HE signal) of a pulse width Pw based on the rising timing pulse and the falling timing pulse. In this way, the pulse width of the driving signal (HE signal) can be set based on the driving signal rising timing data and the driving signal falling timing data. The arrangement shown in FIG. 1 indicates an example of an arrangement using the two HE signal generation circuits 103, and a description will be provided using this arrangement. Note that this is merely an example, and the present invention is not limited to this.

Figure 4:
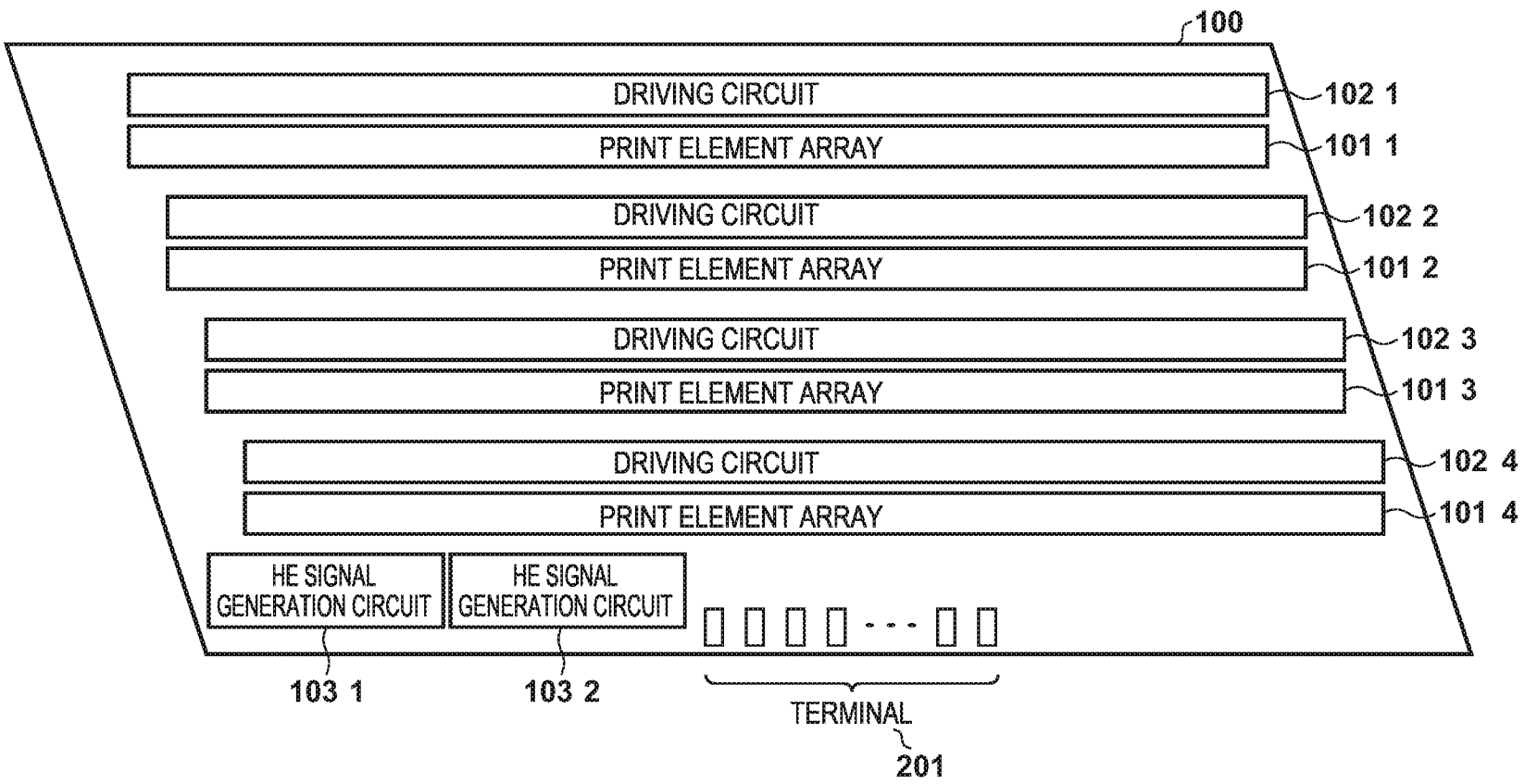
FIG. 4 is a schematic view showing a print element substrate according to the first embodiment.

FIG. 4 is a schematic view showing the print element substrate 100. In the print element substrate 100, terminals 201 for receiving signals such as the DATA signal, CLK signal, LT signal, CLK+ signal, CLK− signal and the driving voltage of the print element, the HE signal generation circuits 103 each for generating an HE signal based on the DATA signal, the print element arrays 101, and the driving circuits 102 are arranged. A plurality of circuit element arrays each including a pair of the print element array 101 and the driving circuit 102 are arranged in parallel in the longitudinal direction of the print element substrate 100. In this example, the print element substrate 100 is formed in a shape of a parallelogram, and the plurality of terminals 201 are arranged in one end portion in the longitudinal direction. The arrangement of the print element arrays and the driving circuits will be additionally explained. As shown in FIG. 4, the print element array 101-1 is arranged slightly closer to the left side than the print element array 101-2. The print element array 101-2 is arranged slightly closer to the left side than the print element array 101-3. In this way, the print element arrays are shifted and arranged in accordance with the planar shape (the tilt of an oblique side) of the print element substrate. The same applies to the arrangement of the driving circuits (102-1 to 102-4). In the above-described arrangement, the wiring distances on the print element substrate 100 between the plurality of terminals 201 and the plurality of print element arrays 101 and driving circuits 102 arranged in parallel are different.

Figure 5:
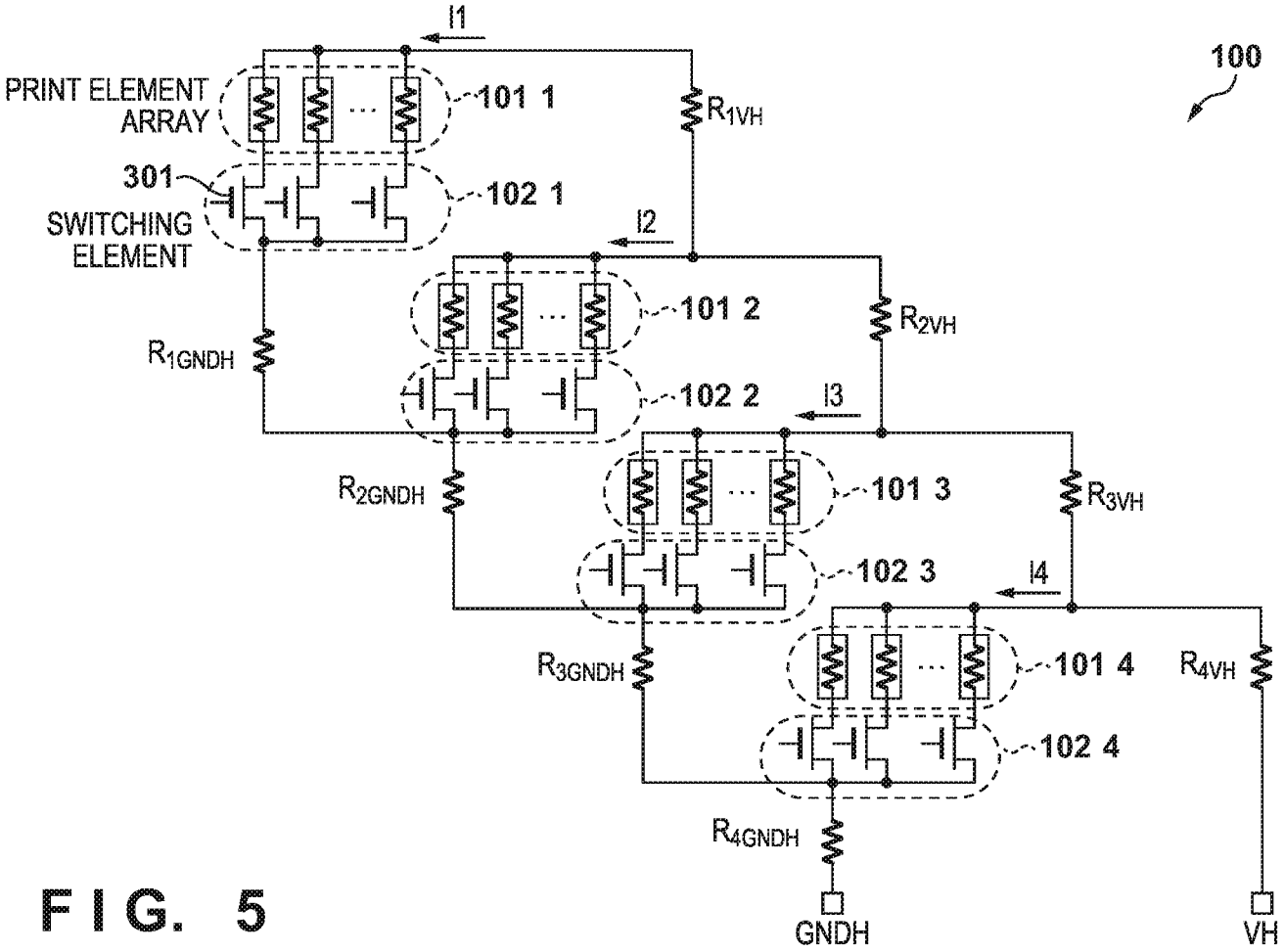
FIG. 5 is a circuit diagram showing an example of a circuit arrangement according to the first embodiment.

FIG. 5 is a schematic circuit diagram showing the electric circuit of the print element substrate 100 corresponding to FIG. 4. The plurality of print elements in each of the plurality of print element arrays 101 are electrically connected to VH and GNDH by a plane wiring (not shown) formed to cover the print element substrate 100. VH is a power supply terminal, and is one of the above-described plurality of terminals 201. A predetermined voltage (for example, 24 V) is input as a driving voltage to the power supply terminal. GNDH is a ground terminal, and is one of the above-described plurality of terminals 201. A ground voltage is input to this ground terminal. Therefore, a voltage of 24 V is applied between VH and GNDH. Note that the power supply terminal and the ground terminal are respectively connected to a power supply terminal and a ground terminal both of which are included in the power supply terminals 192. Each print element is driven by a switching element (a driving element) 301 based on the HE signal and selection data. A plurality of switching elements 301 are provided in the driving circuit 102 in correspondence with the print elements. The switching element 301 is connected to the print element in series. For example, the switching element 301 is a MOS type transistor. A pair of the print element array 101 and the driving circuit 102 (the plurality of switching elements 301) is electrically connected in parallel to VH and GNDH. Since a wiring used for connection is a plane wiring, the wiring distance to the terminal 201 is different among the plurality of print element arrays 101. Therefore, a difference is generated in wiring resistance, and thus a voltage drop is different among the plurality of print element arrays 101. As shown in FIG. 5, the wiring distances (wiring resistances) between the power supply terminal VH and the plurality of print element arrays 101 are different. Furthermore, the wiring distances (wiring resistances) between the ground terminal GNDH and the plurality of driving circuits 102 are different. In FIG. 4 and FIG. 5, in order to simplify the explanation, the latch circuit and the selection circuit are omitted. The latch circuit holds the selection data input to the SR 104 by the LT signal. The selection circuit outputs a selection signal which is a result of logical operation of the HE signal and the selection data to the gate terminal of the MOS type transistor. As a result, the selected switching element 301 is driven. If there is a margin in the space of the drive circuit 102, the drive circuit 102 may include the latch circuit and the selection circuit.

Figure 6:
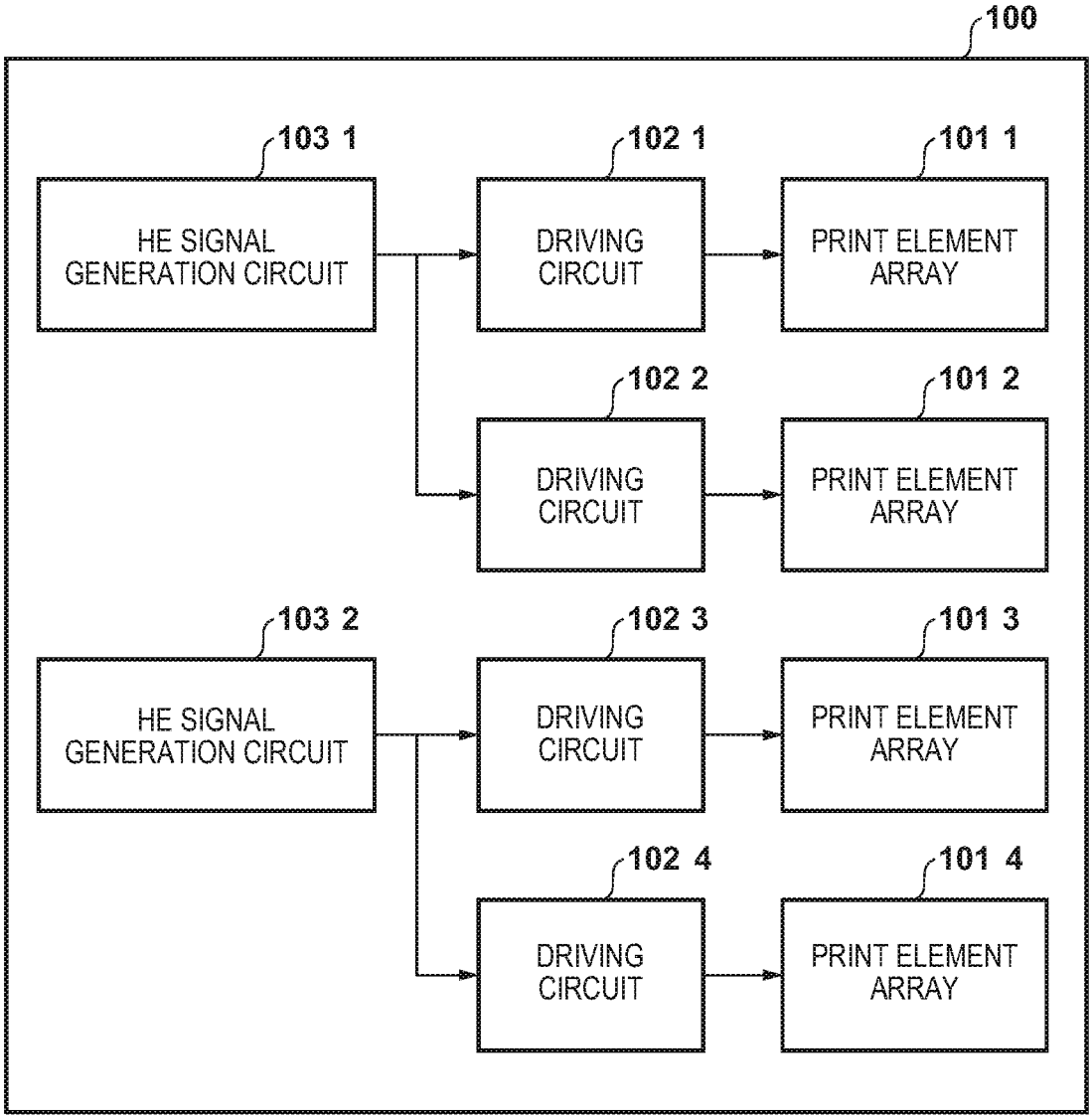
FIG. 6 is a block diagram showing the example of the circuit arrangement according to the first embodiment.

FIG. 6 is a simplified block diagram obtained by extracting only the HE signal generation circuits 103, the driving circuits 102, and the print element arrays 101 from FIG. 5. The print element arrays 101 are driven by the HE signals generated by the HE signal generation circuits 103 the number of which is smaller than that of print element arrays 101. The circuits shown in FIGS. 3 to 6 correspond to each other, and the same kind of components will sequentially be referred to as "first" and "second" from above for the sake of convenience. When an individual description is necessary, a suffix is added to a reference numeral. The suffix of Vd to be described below indicates the print element arrays 101 to be driven simultaneously.

Referring to FIG. 5, if only the first print element array 101-1 is driven, a current I1 flows. A voltage drop Vd11 by a wiring resistance at this time is given by:

$$Vd11=I1\times(R_{1VH}+R_{2VH}+R_{3VH}+R_{4VH}+R_{1GNDH}+R_{2GNDH}+R_{3GNDH}+R_{4GNDH})$$

Next, a case in which the two print element arrays 101 are driven by one HE signal will be described. If the first print element array 101-1 and the second print element array 101-2 are driven, I1 and I2 flow. A voltage drop Vd12 in the first print element array 101-1 at this time is given by:

$$Vd12=I1\times(R_{1VH}+R_{2VH}+R_{3VH}+R_{4VH}+R_{1GNDH}+R_{2GNDH}+R_{3GNDH}+R_{4GNDH})+I2\times(R_{2VH}+R_{3VH}+R_{4VH}+R_{2GNDH}+R_{3GNDH}+R_{4GNDH})$$

That is, the voltage drop increases by an amount given by:

$$\Delta Vd12=Vd12-Vd11=I2\times(R_{2VH}+R_{3VH}+R_{4VH}+R_{2GNDH}+R_{3GNDH}+R_{4GNDH})$$

It is necessary to set, in consideration of the difference (ΔVd), a pulse width enough for the print element to discharge ink.

On the other hand, if the first print element array 101-1 and the fourth print element array 101-4 are driven, I1 and I4 flow. A voltage drop Vd14 in the first print element array 101-1 at this time is given by:

$$Vd14=I1\times(R_{1VH}+R_{2VH}+R_{3VH}+R_{4VH}+R_{1GNDH}+R_{2GNDH}+R_{3GNDH}+R_{4GNDH})+I4\times(R_{4VH}+R_{4GNDH})$$

That is, the voltage drop increases by an amount given by:

$$\Delta Vd14=Vd14-Vd11=I4\times(R_{4VH}+R_{4GNDH})$$

Consider a case in which the resistance value of each print element of each print element array 101 changes depending on discharged ink and a discharge amount. For example, the resistance value of each print element of the first print element array 101-1 may be high, and the current value I1 at this time is small. Similarly, the current values I2, I3, and I4 change depending on the resistance values of the print elements of the print element arrays 101. Thus, the voltage drops Vd11, Vd22, Vd33, and Vd44 in the respective print element arrays 101 have a different magnitude relationship in accordance with I1, I2, I3, and I4. At this time, the print element arrays 101 are preferably driven simultaneously by combinations that suppress the voltage drops at the time of simultaneous driving. Assume, for example, that Vd11>Vd22=Vd33>Vd44 holds. In this case, preferable combinations when driving the print element arrays 101 by the two HE signals are as follows. The first print element array 101-1 and the fourth print element array 101-4 are driven by the first HE signal HE1. Then, the second print element array 101-2 and the third print element array 101-3 are driven by the second HE signal HE2.

Next, a case in which the resistance values of the print elements of the respective print element arrays 101 are equal to each other, that is, I1=I2=I3=I4 will be described. In this case as well, as shown in FIG. 5, the wiring resistances in the respective print element arrays 101 are different. Therefore, the voltage drop changes depending on the print element arrays 101 to be driven simultaneously. In the above example, when paying attention to the first print element array 101-1, the voltage drop when simultaneously driving the second print element array 101-2 is higher than that when simultaneously driving the fourth print element array 101-4. Therefore, when the first print element array 101-1 and the second print element array 101-2 are driven simultaneously, it is necessary to set a pulse width longer than that when the first print element array 101-1 and the fourth print element array 101-4 are driven simultaneously.

However, a pulse width longer than necessary leads to shortening of the life of the print element substrate. As described above, in the arrangement in which the voltage drops in the plurality of print element arrays are different, when performing driving by sharing the HE signal, a combination of print element arrays to be driven simultaneously is important.

When I1=I2=I3=I4, the voltage drops Vd satisfy Vd11>Vd22>Vd33>Vd44. At this time, the print element arrays 101 driven by the same HE signal are preferably the first print element array 101-1 and the third print element array 101-3 or the first print element array 101-1 and the fourth print element array 101-4.

A practical example will be explained next. Each print element array 101 includes the plurality of print elements and the plurality of print elements are assigned to a plurality of blocks. The print element array 101 drives each block. In other words, the print elements are driven at a different timing for each block. Therefore, the print elements belonging to the same block are driven simultaneously, and the print elements belonging to different blocks are driven at different timings. In this way, the plurality of print elements of each print element array 101 are driven for each block, that is, time-divisionally driven. If time-divisional driving is performed, when all the print elements belonging to the blocks driven simultaneously are driven, the voltage drop becomes maximum. The voltage drop of each print element array 101 is proportional to a flowing current. Thus, when the number of print elements that are turned on simultaneously in each print element array 101 is largest, the maximum voltage drop is obtained. If the voltage drops of the respective print elements in each print element array 101 are different, a largest one of the voltage drops is regarded as the maximum voltage drop.

Assume, for example, that the maximum voltage drops of the respective print element arrays 101 are Vd11max=330 mV, Vd22max=230 mV, Vd33max=130 mV, and Vd44max=30 mV. At this time, if the first print element array 101-1 and the second print element array 101-2 are driven simultaneously by the HE signal HE1, a voltage drop Vd12max generated in the first print element array 101-1 is given by 330 mV+230 mV=560 mV. On the other hand, if the third print element array 101-3 and the fourth print element array 101-4 are driven simultaneously by the HE signal HE2, a voltage drop Vd34max generated in the third print element array 101-3 is given by 130 mV+30 mV=160 mV. In the case of these combinations, it is necessary to set a relatively long pulse width for the HE signal HE1, causing shortening of the life of the print element.

A preferred mode will be described next. If the first print element array 101-1 and the third print element array 101-3 are driven simultaneously by the HE signal HE1, a voltage drop Vd13max generated in the first print element array 101-1 is given by 330 mV+130 mV=460 mV. On the other hand, if the second print element array 101-2 and the fourth print element array 101-4 are driven simultaneously by the HE signal HE2, a voltage drop Vd24max generated in the second print element array 101-2 is given by 230 mV+30 mV=260 mV. Thus, the voltage drop when performing driving by the HE signal HE1 is lower than that when driving the first print element array 101-1 and the second print element array 101-2 simultaneously. This indicates that the difference (Vd13max−Vd24max=460 mV−260 mV=200 mV) between the sums of the maximum voltage drops in the print element arrays 101 driven by the respective HE signals is preferably smaller than the largest value (Vd11max=330 mV) of the maximum voltage drops (Vd11max, Vd22max, Vd33max, and Vd44max) of the respective print element arrays. In other words, the plurality of HE signals are assigned to the print element arrays 101 so that the difference between the largest and smallest values of the sums of the maximum voltage drops of the respective pairs of the print element arrays 101 is smaller than the largest value of the voltage drops of the plurality of print element arrays.

Another preferred mode will be described. If the first print element array 101-1 and the fourth print element array 101-4 are driven simultaneously by the HE signal HE1, a voltage drop Vd14max generated in the first print element array 101-1 is given by 330 mV+30 mV=360 mV. On the other hand, if the second print element array 101-2 and the third print element array 101-3 are driven simultaneously by the HE signal HE2, a voltage drop Vd23max generated in the second print element array 101-2 is given by 230 mV+130 mV=360 mV. In this case as well, the voltage drop Vd23max when performing driving by the HE signal HE1 is lower than the voltage drop when driving the first print element array 101-1 and the second print element array 101-2 simultaneously. This arrangement example is a preferred mode since the difference (Vd14max−Vd23max=360 mV−360 mV=0 mV) between the sums of the maximum voltage drops in the print element arrays 101 driven by the respective HE signals is smaller than the largest value (Vd11max=330 mV) of the maximum voltage drops (Vd11max, Vd22max, Vd33max, and Vd44max) of the respective print element arrays 101.

As described above, in this embodiment, two groups each formed by two print element arrays are determined, and different HE signal generation circuits are assigned to the two groups, respectively. In other words, the HE signal generation circuits are provided for each group. The two HE signal generation circuits 103 assigned to the groups respectively output the HE signals at different timings. By defining a combination (assignment) of print element arrays to be driven simultaneously by one HE signal, it is possible to suppress shortening of the life of the print element by avoiding setting of an excessive pulse width while reducing the cost by sharing the HE signal to reduce a circuit space.

Second Embodiment

Figure 7:
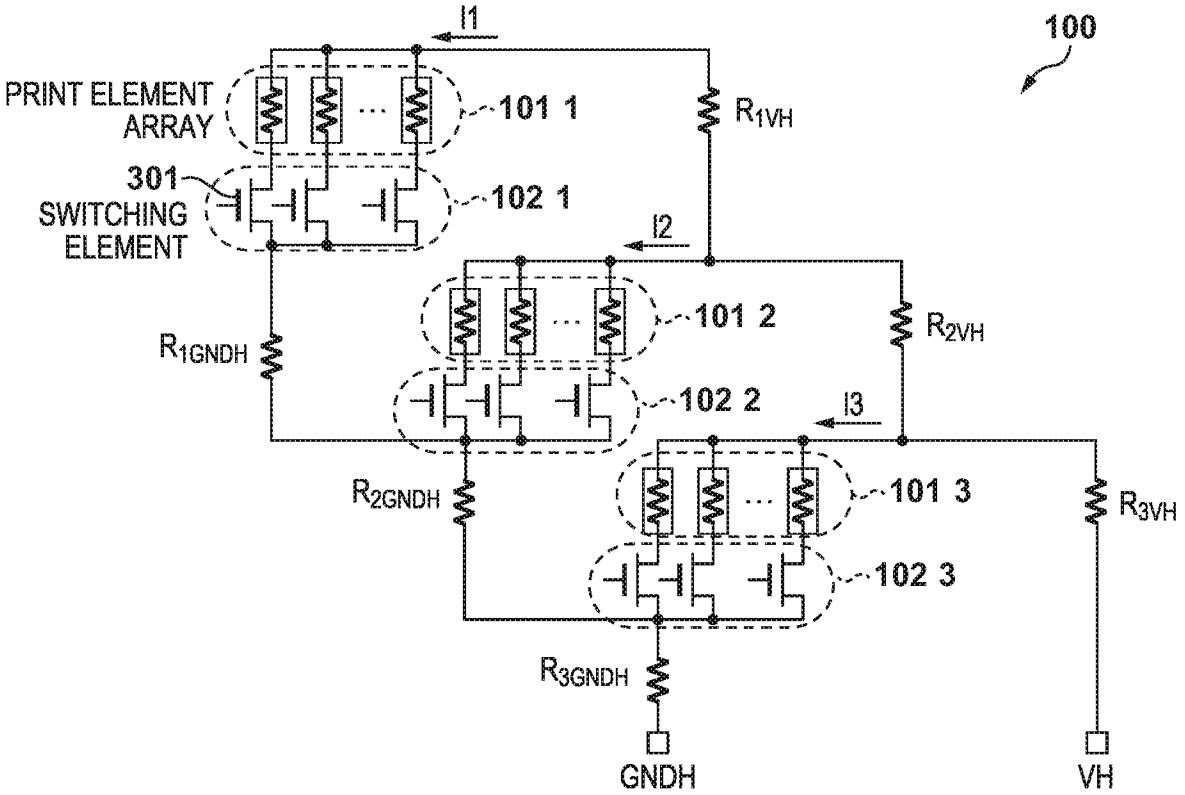
FIG. 7 is a circuit diagram showing an example of a circuit arrangement according to the second embodiment.

As the second embodiment of the present invention, a case in which three print element arrays 101-1 to 101-3 are driven by two HE signals (HE1 and HE2), as shown in FIG. 7, will be described next.

Figure 8:
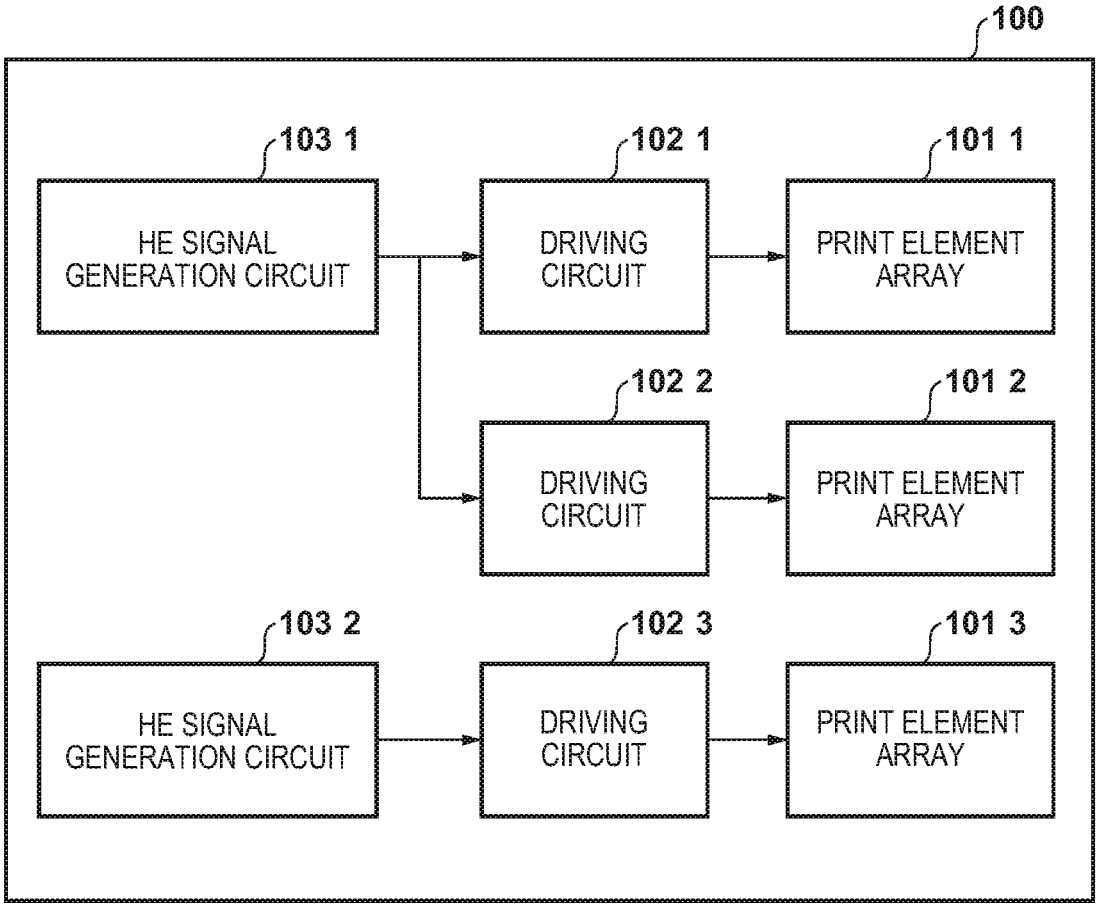
FIG. 8 is a block diagram showing the example of the circuit arrangement according to the second embodiment.

FIG. 8 is a simplified block diagram obtained by extracting only HE signal generation circuits 103, driving circuits 102, and print element arrays 101 from FIG. 7. Consider a case in which the maximum voltage drops of the respective print element arrays 101 are Vd11max=600 mV, Vd22max=500 mV, and Vd33max=400 mV. In this case, if the first print element array 101-1 and the second print element array 101-2 are driven simultaneously by the HE signal HE1, a generated voltage drop Vd12max is given by 600 mV+500 mV=1100 mV. On the other hand, if the third print element array 101-3 is driven by the HE signal HE2, a generated voltage drop Vd33max is 400 mV. This is not preferable since the difference (Vd12max−Vd33max=1100 mV−400 mV=700 mV) between the sums of the maximum voltage drops in the print element arrays 101 driven by the respective HE signals is larger than the largest value (Vd11max=600 mV) of the maximum voltage drops (Vd11max, Vd22max, and Vd33max) of the print element arrays 101.

This indicates that if the difference between the sums of the maximum voltage drops in the print element arrays 101 driven by the respective HE signals is larger than the largest value of the maximum voltage drops of the print element arrays 101, the print element array 101 in which the largest value of the maximum voltage drops is obtained is preferably driven by another HE signal. That is, in the above example, when the first print element array 101-1 and the third print element array 101-3 are driven simultaneously by the HE signal HE2, Vd13max=600 mV+400 mV=1000 mV and Vd22max=500 mV are obtained. As a result, a voltage drop generated in the print element array 101 can be reduced.

In the above example, assume that the first print element array 101-1 is driven by the HE signal HE1 and the second print element array 101-2 and the third print element array 101-3 are driven by the HE signal HE2. This is a preferable example since Vd11max=600 mV, Vd23max=500 mV+400 mV, and Vd23max−Vd11mx=300 mV<Vd11max=600 mV.

In the arrangement according to this embodiment as well, it is possible to obtain the same effect as in the first embodiment.

Third Embodiment

Figure 9:
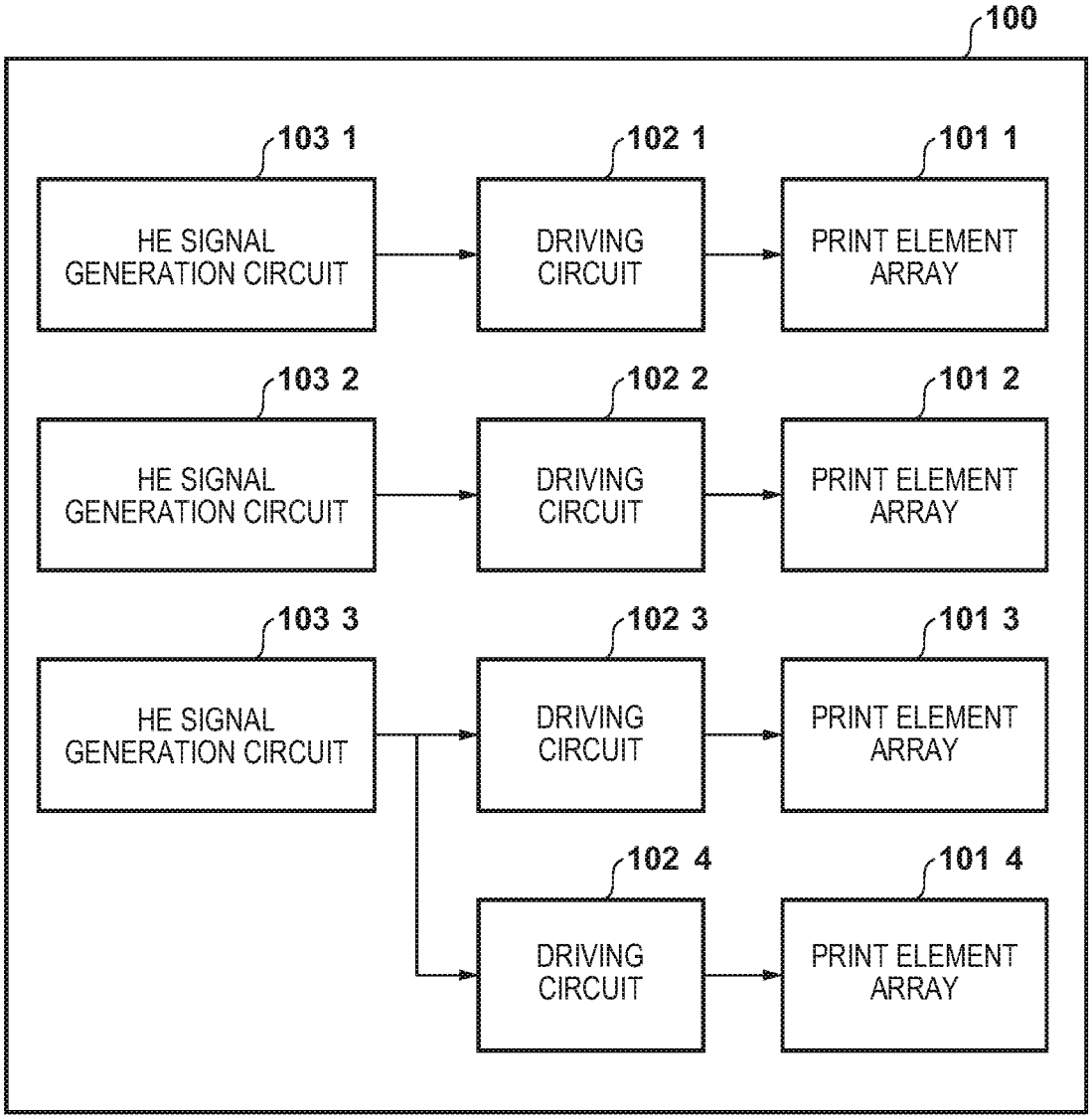
FIG. 9 is a block diagram showing an example of a circuit arrangement according to the third embodiment.

As the third embodiment of the present invention, a case in which four print element arrays 101-1 to 101-4 are driven by three HE signals (HE1, HE2, and HE3) shown in FIG. 9 will be described. In the third embodiment, one group formed by two of the four print element arrays 101 is determined and one of three HE signal generation circuits 103 is assigned to this group. The remaining two HE signal generation circuits 103 are respectively assigned to the remaining two print element arrays 101. The three HE signal generation circuits 103 respectively output the HE signals at different timings.

Consider a case in which the maximum voltage drops of the print element arrays 101-1 to 101-4 are Vd11max=400 mV, Vd22max=300 mV, Vd33max=200 mV, and Vd44max=100 mV. In this case, if the first print element array 101-1 and the second print element array 101-2 are driven simultaneously by the HE signal HE1, a generated maximum voltage drop Vd12max is given by 400 mV+300 mV=700 mV. On the other hand, if the third print element array 101-3 is driven by the HE signal HE2, the maximum voltage drop Vd33max generated in the third print element array 101-3 is 200 mV. Furthermore, if the fourth print element array 101-4 is driven by the HE signal HE3, the maximum voltage drop Vd44max generated in the fourth print element array 101-4 is 100 mV.

In this case, the difference between the sums of the maximum voltage drops in the print element arrays 101 driven by the respective HE signals is largest with respect to the HE signals HE1 and HE3. As a result, Vd12max−Vd44max=700 mV−100 mV=600 mV is larger than the largest value (Vd11max=400 mV) of the maximum voltage drops (Vd11max, Vd22max, Vd33max, and Vd44max) of the respective print element arrays, and thus the above arrangement is not preferable.

In the above example, the first print element array 101-1 is driven by the HE signal HE1. The second print element array 101-2 is driven by the HE signal HE2. Then, it is preferable to drive the third print element array 101-3 and the fourth print element array 101-4 by the HE signal HE3. At this time, the voltage drops Vd are Vd11max=400 mV, Vd22max=300 mV, and Vd34max=200 mV+100 mV=300 mV. The voltage drops for the respective HE signals are averaged.

In the arrangement according to this embodiment as well, it is possible to obtain the same effect as in the first embodiment.

Fourth Embodiment

Figure 10:
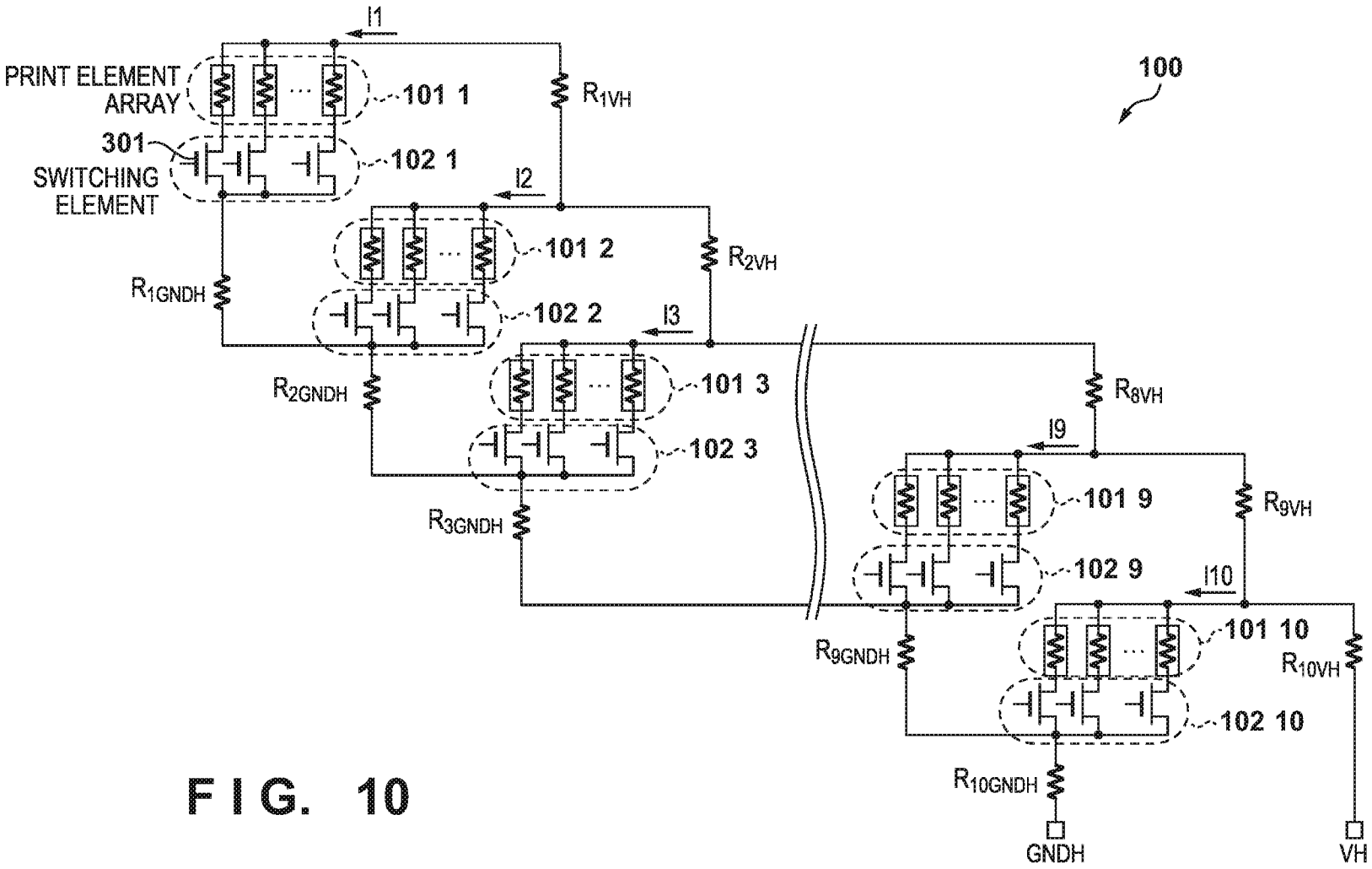
FIG. 10 is a circuit diagram showing an example of a circuit arrangement according to the fourth embodiment.

As the fourth embodiment of the present invention, a case in which 10 print element arrays 101 are provided will be described. FIG. 10 shows a case in which two HE signals and 10 print element arrays are provided. In this case, as a preferable driving method for HE signals HE1 and HE2 when the relationship among maximum voltage drops in the print element arrays 101-1 to 101-10 satisfies Vd11max>Vd22max>Vd33max>Vd44max>Vd55max>Vd66max>Vd77max>Vd88max>Vd99max>Vd1010max, the following combinations are given. The print element arrays 101-1, 101-3, 101-5, 101-7, and 101-9 are driven by HE1. Then, the print element arrays 101-2, 101-4, 101-6, 101-8, and 101-10 are driven by HE2. As another preferable driving method, the print element arrays 101-1, 101-2, 101-3, 101-9, and 101-10 are driven by HE1. Then, the print element arrays 101-4, 101-5, 101-6, 101-7, and 101-8 are driven by HE2.

Figure 13:
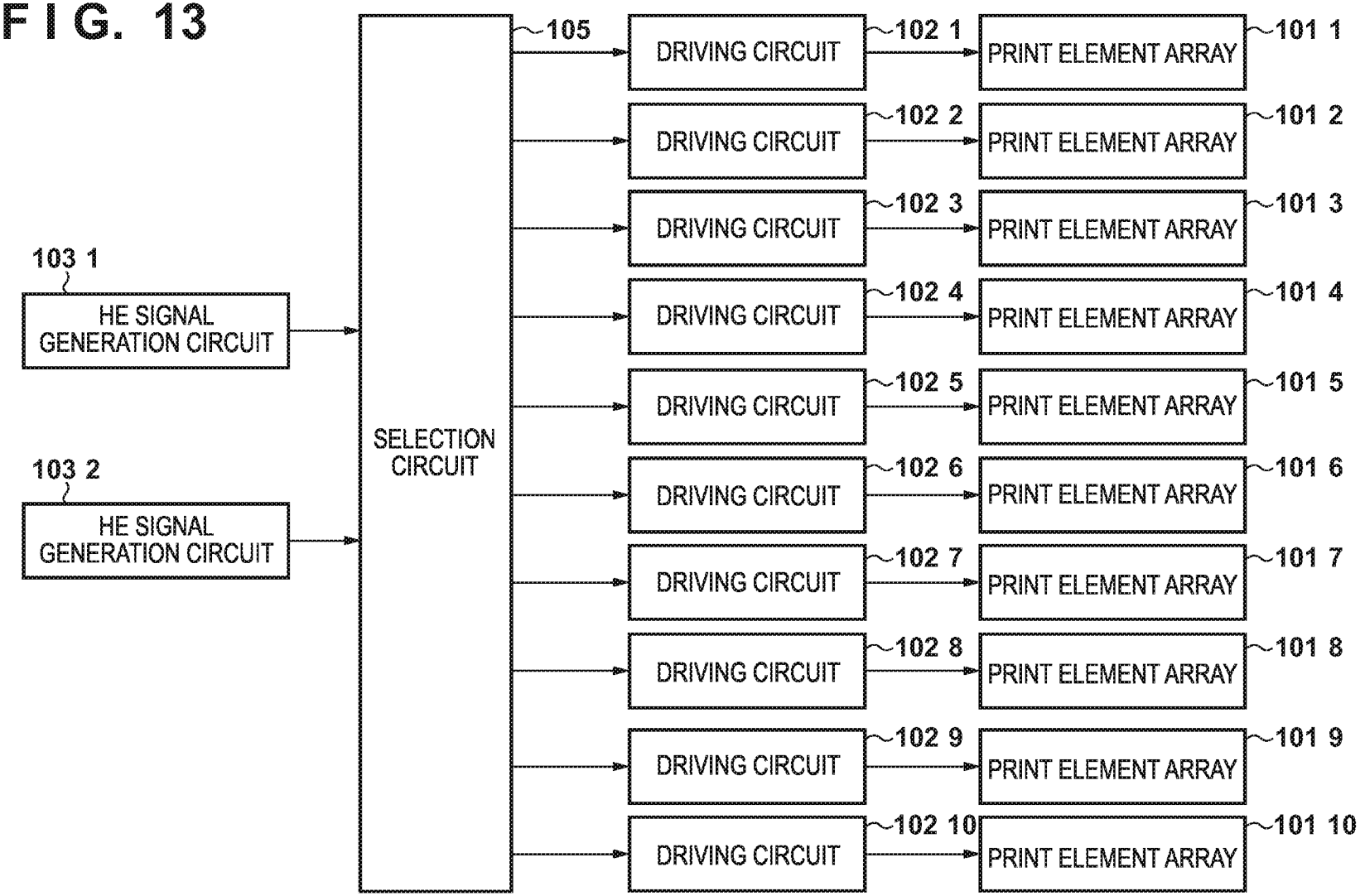
FIG. 13 is a block diagram showing the example of the circuit arrangement according to the fourth embodiment.
Figure 14:
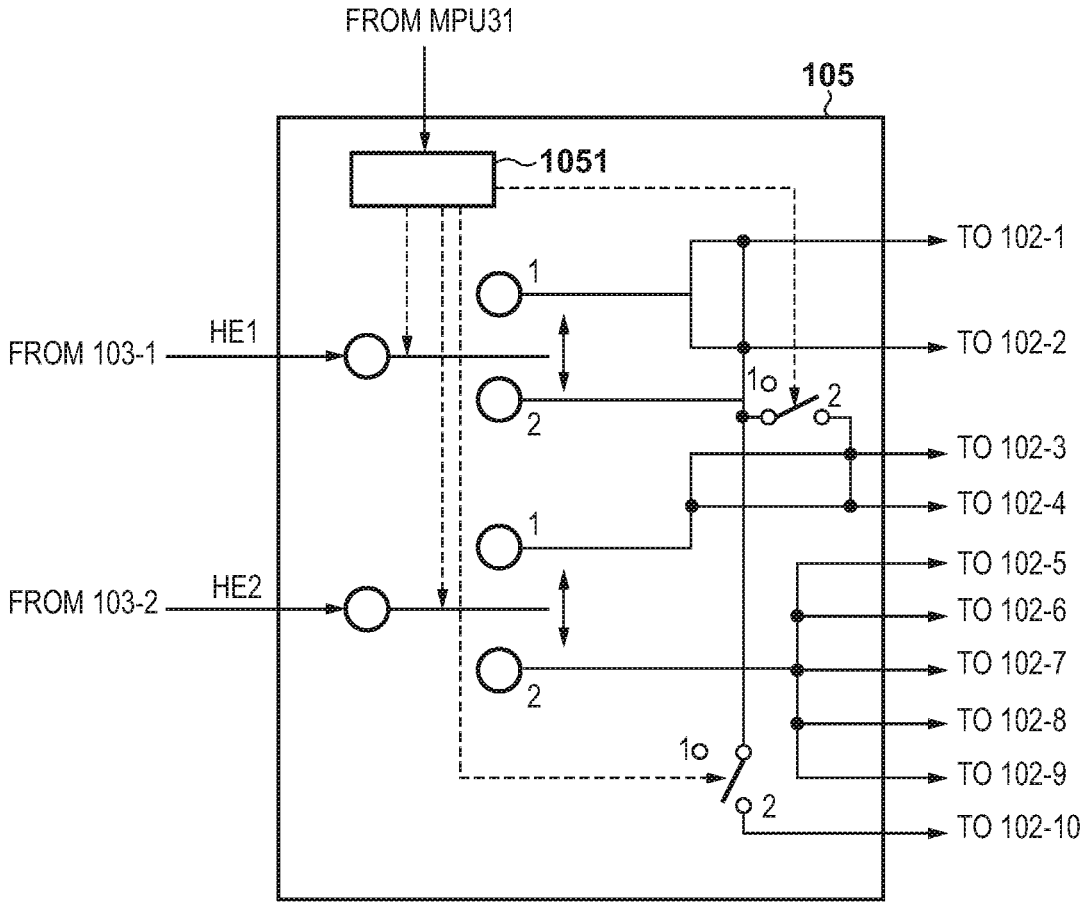
FIG. 14 is a circuit diagram showing an example of a circuit arrangement according to the fourth embodiment.

The print element arrays 101 driven by each HE signal may be variable. For example, the assignment destination (output destination) of each HE signal may be changed in accordance with the print mode of a printing apparatus 1. More specifically, the printing apparatus 1 can operate in a plurality of print modes (for example, a color mode and a monochrome mode). In the color mode, the print element arrays 101-1 to 101-4 and 101-10 are driven by HE1. Then, the print element arrays 101-5 to 101-9 are driven by HE2. On the other hand, in a specific mode such as the monochrome mode (for example, a mode in which only the print element arrays 101-1 to 101-4 are used), the print element arrays 101-1 and 101-2 are driven by the HE1. Then, the print element arrays 101-3 and 101-4 are driven by HE2. FIG. 13 is a simplified block diagram obtained by extracting HE signal generation circuits 103, driving circuits 102, the print element arrays 101, and a selection circuit 105 from FIG. 10. The selection circuit 105 changes the assignment destinations (output destinations) of the HE signals. FIG. 14 is a circuit diagram for explaining an example of the arrangement of the selection circuit 105. The selection circuit 105 changes the assignment destinations (output destinations) by switching a pair of switches to "1" or "2". A switching unit 1051 executes switching based on an instruction from an MPU 31. In the arrangement shown in FIG. 14, if the switches are switched to "1", HE1 is output to the driving circuits 102-1 and 102-2 and HE2 is output to the driving circuits 102-3 and 102-4. On the other hand, if the switches are switched to "2", HE1 is output to the driving circuits 102-1 to 102-4 and 102-10 and HE2 is output to the driving circuits 102-5 to 102-9.

In the arrangement according to this embodiment as well, it is possible to obtain the same effect as in the first embodiment.

Other Embodiments

The above embodiments have explained a case in which a voltage drop is generated due to the wiring resistance of each print element array in the arrangement of a plane wiring formed to cover the print element substrate. However, the present invention is not limited to the plane wiring, and is also applicable to an arrangement in which print element arrays are connected in parallel.

The above embodiments have provided the description by exemplifying a case in which currents flowing in some print element arrays are equal to each other. However, even if currents flowing in the respective print element arrays are different, the present invention is applicable to an arrangement in which voltage drops in the respective print element arrays are different.

The above embodiments have explained an example in which the driving signal generation circuits each for generating a print element driving signal are provided in the print element substrate. However, it is possible to obtain the same effect even by providing the driving signal generation circuits outside the print element substrate.

The present invention is applicable to various print elements such as a heating resistor and a piezoelectric element.

In the above examples, an example of the shape of the print element substrate is a parallelogram different from a rectangle. The present invention is not limited to this. Another shape which obtains a wiring such that a voltage drop is different among the print element arrays may be used. For example, an arrangement in which a connecting portion between print element substrates has a step shape may be adopted.

The above embodiments have exemplified FIG. 4 as an example of the arrangement of the circuits and terminals in the print element substrate 100. The present invention, however, is not limited to this. For example, the positions of the terminals may be provided in the widthwise direction of the print element substrate 100, or provided in a plurality of end portions. The present invention is also applicable to this arrangement if a difference in voltage drop is generated between circuit element arrays. In FIG. 4, the print element array 101 and the driving circuit 102 are arranged in parallel in a plane. However, as another embodiment, the print element array 101 and the driving circuit 102 may be arranged in parallel in the stacking direction of the print element substrate 100 (vertical direction to the page of FIG. 4).

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-125587, filed Jun. 27, 2017, and No. 2018-106311, filed Jun. 1, 2018, which are hereby incorporated by reference herein in their entirety.

What is claimed is:

1. A print element substrate comprising:

N (≥3) print element arrays each including a plurality of print elements wherein the print element arrays are connected in parallel, via connected wirings, to an input unit to which a predetermined voltage is input;

a signal generation unit configured to generate M (≥2, <N) driving signals for driving the N print element arrays wherein each of the driving signals determines a period during which the print element is driven; and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

2. The substrate according to claim 1, wherein distances of the connected wirings from the input unit to the N print element arrays are different from each other.

3. The substrate according to claim 1, wherein resistances of the connected wirings from the input unit to the N print element arrays are different from each other.

4. The substrate according to claim 1, wherein the driving unit includes N driving circuits in correspondence with the N print element arrays, and distances of the connected wirings from the input unit to the N driving circuits are different from each other.

5. The substrate according to claim 1, wherein the driving unit includes N driving circuits in correspondence with the N print element arrays, and resistances of the connected wirings from the input unit to the N driving circuits are different from each other.

6. The substrate according to claim 1, wherein the print element arrays have a shape of a parallelogram.

7. A printhead comprising a plurality of print element substrates, each of the plurality of print element substrates including N (≥3) print element arrays each including a plurality of print elements wherein the print element arrays are connected in parallel, via connected wirings, to an input unit to which a predetermined voltage is input, a signal generation unit configured to generate M (≥2, <N) driving signals for driving the N print element arrays wherein each of the driving signals determines a period during which the print element is driven, and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

8. The printhead according to claim 7, further comprising a power supply terminal electrically connected to supply power to the plurality of print element substrates.

9. A printing apparatus comprising a plurality of print element substrates, each of the plurality of print element substrates including N (≥3) print element arrays each including a plurality of print elements wherein the print element arrays are connected in parallel, via connected wirings, to an input unit to which a predetermined voltage is input, a signal generation unit configured to generate M (≥2, <N) driving signals for driving the N print element arrays wherein each of the driving signals determines a period during which the print element is driven, and a driving unit configured to drive, based on the M driving signals respectively generated by the signal generation unit for M groups, the N print element arrays that are assigned to the M groups so that each group includes one print element array or a plurality of print element arrays wherein the driving unit simultaneously drives the one print element array belonging to the corresponding groups or the plurality of print element arrays belonging to the corresponding groups for each group, wherein if, among N amounts of voltage drops respectively generated in the N print element arrays in response to application of the predetermined voltage, the amount of the voltage drop when the number of print elements driven simultaneously in each print element array is largest is set as an amount of an array voltage drop of each of the N print element arrays, and a sum of the amounts of the array voltage drops of the print element arrays assigned to each of the M groups is set as an amount of a group voltage drop, a difference between a largest value and a smallest value of the M amounts of the group voltage drops corresponding to the M groups is smaller than a largest value of the N amounts of the array voltage drops corresponding to the N print element arrays.

* * * * *